United States Patent [19]

Klein

[11] 4,440,011

[45] Apr. 3, 1984

[54] LOCK POSITION INDICATOR

[76] Inventor: Martin Klein, 18542 Cylmer St., Northridge, Calif. 91326

[21] Appl. No.: 270,264

[22] Filed: Jun. 4, 1981

[51] Int. Cl.[3] ..... A47G 29/10; E05B 41/00

[52] U.S. Cl. ..... 70/438; 40/330; 40/492; 40/508; 70/432; 70/456 R; 116/200; 116/307; 116/309; 116/313

[58] Field of Search ..... 70/432, 438, 431, 456 R, 70/395, 408; 40/2 A, 492, 2 R, 508, 27.5, 330; 116/307, 309, 313, 200

[56] References Cited

U.S. PATENT DOCUMENTS

| | | | |
|---|---|---|---|
| 1,237,115 | 8/1917 | Stein | 70/432 |
| 1,843,335 | 2/1932 | Oberfield | 70/395 |
| 2,176,465 | 10/1939 | Merkl | 70/395 |
| 2,198,484 | 4/1940 | Merkl | 70/432 |
| 2,373,893 | 4/1945 | Hoenger | 70/432 |
| 2,418,046 | 3/1947 | Oberfield | 70/395 |
| 2,561,944 | 7/1951 | Oberfield | 70/432 |
| 2,778,217 | 1/1957 | Duyn | 70/456 R |

FOREIGN PATENT DOCUMENTS

| | | | |
|---|---|---|---|
| 577756 | 5/1933 | Fed. Rep. of Germany | 70/395 |
| 254743 | 12/1948 | Fed. Rep. of Germany | 70/395 |
| 510358 | 7/1939 | United Kingdom | 70/456 R |

*Primary Examiner*—Thomas J. Holko
*Assistant Examiner*—Lloyd A. Gall
*Attorney, Agent, or Firm*—Don B. Finkelstein

[57] ABSTRACT

A casing for holding a key in one of two pivoted positions. The key pivots about an axis extending along one edge thereof when a lock is turned by the user of the key. An indicator may be attached to the key for extension through a small opening in the casing or housing when the key is in one position and for retraction below the level of the casing periphery when the key is in the opposite position. In a second embodiment, a portion of the casing may be pierced along three edges and arranged so that, when the key is in one position, the pierced portion is pushed above the casing periphery and, when the key is pivoted to the second position, the pierced portion is coextensive with or below the casing periphery. In a third embodiment, an indicator may be pivotally fastened in position between halves of the casing for movement (a) above and (b) even with or below the periphery of the casing when the key is pivoted.

15 Claims, 9 Drawing Figures

LOCK POSITION INDICATOR

BACKGROUND OF THE INVENTION

As most people are aware, many locks are automatically actuated when a door is closed so that the door cannot be reopened from the outside without a key. However, a large number of locks are used, for example as deadbolts, which must be acutated from the outside with a key to lock and unlock the door.

With today's rapidly increasing crime rates, people must take additional steps to ensure not only their own safety, but also the security of their possessions from crimes such as robbery and burglary. As a result, many home owners and business people are adding additional locks to their doors, usually in the form of deadbolts which are normally more secure than the standard door knob lock.

On many occassions, when someone leaves a building, in order to ensure the necessary safety of the possessions left in the building, as well as the security of the next person to reenter, it is important that key actuated locks, such as deadbolts, security alarms, etc., be actuated. On the other hand, pressure to get to the next place of activity, forgetfulness, etc., often cause people either to forget to actuate the locks or to be unable to remember later whether or not they did actuate the locks. It often happens, for example, that someone will travel a distance from the building which was to be secured, suddenly remember that he should have secured it, but be unable to remember whether or not he actually did.

In such instances, it would be extremely helpful to such people to have a memory aid so that they would be able to instantly determine whether or not they had actuated the locks. Without such an aid, the individuals concerned must either take a chance about the security, hoping for the best, or return to the building, wasting time and energy.

Accordingly, a need has long existed to provide a very convenient, unforgetable memory aid which will immediately reveal whether or not a lock was actuated. In the past, various inventors have come up with memory aids which, had they been practical, would have provided such a clear indication. Those inventors came up with devices which could be attached to the key used to actuate the lock and provide an indication as to whether or not the key had been used as required. An early device of this type is shown in U.S. Pat. No. 1,237,155 which depicts a key and a lock having an indicator system which would be actuated when the key was turned in the lock. However, that device was only theoretically useful since it was so intricate and complex as to be impractical. The head or handle of the key had to be provided with moving levers which were actuated by a cam on the face of the lock itself, thus requiring not only a special lock, but also a very expensive key.

U.S. Pat. Nos. 1,843,335 and 2,418,046 each depict a key which has to be slotted and provided with special hardware, including springs, cams, etc., which are actuated when the key is turned. In the case of the earlier of these patents, the lock has to be modified to allow entry of a cam into the lock for cooperation with a fixed pin for movement of the cam to provide the desired indication. In a later patent, the cam is actuated by contact with the face of the lock itself. These devices were both impractical because of the intricate and delicate nature of the structures involved and they further required that the lock either have a special face or a flat face which could cooperate with the cams to provide the desired indications.

U.S. Pat. No. 2,561,944 discloses the use of a casing which snaps onto the head or handle of a key. The casing is provided with a spring-biased indicator which is pushed against the lock face when the key is inserted. Rotational movement of the key causes the indicator to pivot to expose an indicator symbol, again requiring that the lock have a flat face with which the indicator comes into contact to cause the pivoting. Further the structure requires small and intricate parts including springs, etc., which are difficult and expensive to assemble and maintain in proper operation.

U.S. Pat. No. 2,373,893, also discloses a device which requires that the lock be provided with a special face and that the key be intricately and delicately machined and provided with moving parts. This device is very expensive and difficult to produce and maintain.

U.S. Pat. Nos. 2,176,464 and 2,198,484 both disclose keys which provide an actuation indication, but which have to be produced in multiple sections with relatively intricated machining, requiring expensive assembly, etc.

Further, most of the above-described inventions are deficient because they require special keys, thus preventing the user from employing the different indicator systems with nearly any key he might have in his pocket. Also, in almost every instance, the inventions were disclosed on the assumption by the inventors that all locks work in a single direction, i.e., clockwise rotation of every lock will lock it and counterclockwise rotation of every lock will unlock it. Obviously, this is not true since locks must be able to work in different directions for different applications. In most cases, the position of the particular structure relative to the juncture of the handle and shank is relatively critical since the lock face must be used to actuate the indicator.

Consequently, a need still exists for a very simple, inexpensive device which can be employed with nearly any standard key to provide an indication to the user as to whether he last actuated a lock to lock it or unlock it.

SUMMARY OF THE INVENTION

The present invention relates to such a device and comprises a casing or housing which can be attached to the head or handle of a key and provide an indication of the most recent position of the key in a lock. Movement of the key within the housing is inhibited, but not prohibited. Thus, when the user inserts the key into a lock and exerts a force on the housing to rotate the lock, the key will assume a position in the housing opposite that in which the force is exerted. Consequently, the user need only look at the key and asertain its position relative to the housing to recall the last direction in which he turned the lock. The device does not require any cam contact with the lock, thus allowing the device to be used with any lock, obviating the requirement to modify the face or structure of the lock and also obviating the requirement for the end of the casing nearest the shank to have any particular position such that a cam can contact a flat surface on the lock. In other words, the particular relationship of the housing relative to the shank, the particular shape of the lock face, and the particular type of key are subtantially inconsequential insofar as the present invention is concerned.

In one embodiment, the key may be provided with a small indicator-receiving slot or pierced area. A corresponding aperture can be provided in the side of the casing so that, when the key is pivoted to one position, the indicator extends slightly beyond the periphery of the casing. In the opposite position within the housing, the indicator will be withdrawn so that the fingers of the user will be able to feel it.

Preferably, the casing is provided with an opening which, in cross-section, is approximately a truncated triangle with a first wall of approximately the same width as the standard thickness of most keys available today. The opposite, second wall in the housing is much wider so that the key can pivot about an axis at approximately the location of the first edge of the key positioned against the first wall.

If desired, a flat leaf spring can be provided against the second wall of the opening or recess to bear against the movable edge of the key and thus inhibit pivoting of the second edge of the key from one side of the casing to the other.

In a second embodiment, the housing may be provided with a curved surface in the larger, second wall which inhibits movement of the key. If desired, a partial piercing may be accomplished in that same second wall of the housing so that, when the key is in one pivotal position, the partial piercing is pushed above the periphery of the housing and, when the key is in the other pivotal position, the partial piercing reverts to the normal position either coextensive with the periphery of the housing or below that periphery.

In a third embodiment of the invention, if the housing is made in separate, mating halves, a shaft receiving opening, extending substantially parallel to the key-receiving opening, may be provided. A pivotable shaft may be mounted in the shaft-receiving opening and a paddle-like indicator may be attached to that shaft for movement into and out of the housing as the key is pivoted therein.

Regardless of the particular structure employed, in the usual instance, the only work which would have to be accomplished before attaching the housing to the head or handle of a key would be the grinding of the latter so as to provide at least one flat edge. If desired, external indicators, per se, may be completely eliminated since the relative position of the housing and the key may be sufficient to indicate the last direction of movement of the key in a lock. It is acknowledged, however, that the use of an indicator which protrudes from the housing periphery will enable the user to quickly determine the position of the key in the housing without even having to remove the key from his pocket.

The present invention may be embodied in a wide variety of structures and, in order to clearly depict examples of such structures, the following detailed description is set forth.

DETAILED DESCRIPTION

Figure 1:
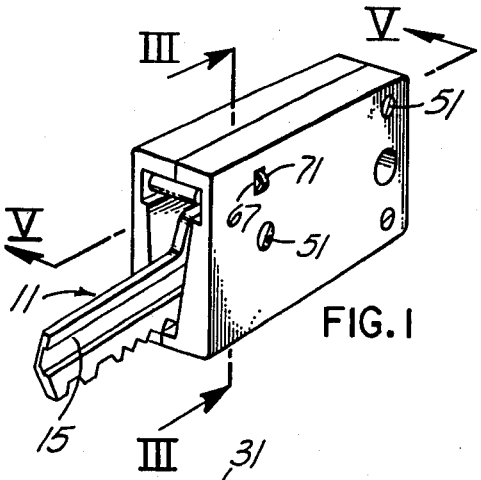
FIG. 1 comprises a perspective illustration of a preferred embodiment of a device formed in accordance with the present invention.
Figure 5:
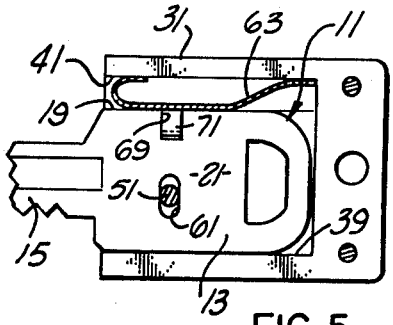
FIG. 5 comprises a partial view of the device shown in FIG. 1, as seen along a line V—V.
Figure 2:
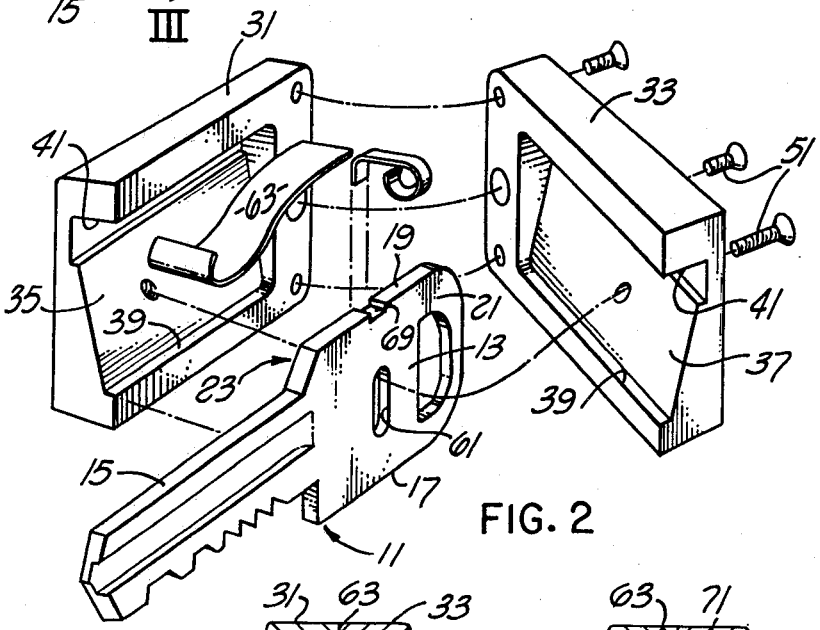
FIG. 2 comprises an exploded view of the device shown in FIG. 1.

Referring now to FIGS. 1–5 in greater detail, there is shown a key 11 having a head or handle 13 and a shank 15. As particularly shown in FIG. 2, the key is preferably provided with a first edge 17 and a second, opposed edge 19. Although it will be realized by those skilled in the art that many forms of the invention might be provided which do not require that either edge 17 or 19 be flat or straight, or even parallel, in the preferred embodiments depicted here, that is the case since it will provide a more universal application of the invention, i.e., the key can be installed in the device with either edge 17 or 19 in the relationship to be described below. Thus, it will be realized that the key 11 depicted in FIG. 5 is of somewhat different configuration than that shown in FIG. 2, but the difference is immaterial for the purpose of the present invention.

In any event, the handle 13 may be provided with a first face 21 and a second face 23.

Figure 3:
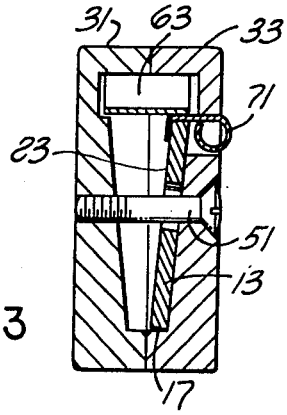
FIG. 3 comprises a cross-sectional view of the device shown in FIG. 1, as taken along a line III—III thereof.
Figure 4:
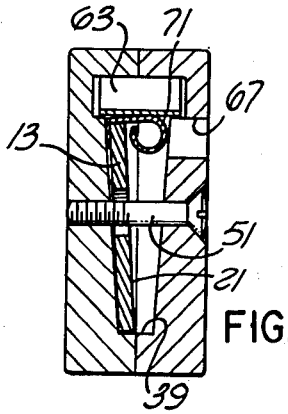
FIG. 4 comprises a view similar to FIG. 3, with the key pivoted to the opposite extremity of movement.

In this particular embodiment, a casing or housing is depicted as having a first half 31 and a second half 33 which substantially mate with one another. A recess 35 may be provided in one of the sections of the housing and a recess 37 provided in the second section. Preferably, one edge 39 of each of the recesses is relatively narrow in this embodiment. The opposite, second edge 41 is relatively wider, and each recess is provided with a substantially uniformly extending side wall surface intermediate the edges 39 and 41. Thus, as seen in FIGS. 3 and 4, when the housing sections 31 and 33 are joined, such as by means of one or more screws 51, the combined recesses will form a substantially triangular opening in cross-sectional configuration, preferably truncated at one end thereof. As can be seen in FIGS. 3 and 4, one of the screws 51 may pass through an opening 61 in the key so as to positively retain the key within the housing or casing.

Again referring to FIGS. 3 and 4, it can be seen that one edge, such as 17, of the key may be positioned against the narrow wall 39 of the opening and the other edge 19 of the key may be positioned closer to the upper wall 41 of the opening. Thus, the key can move from the position shown in FIG. 3 to that shown in FIG. 4, and back again.

In order to inhibit the movement of the key from one position to the other, a flat leaf spring 63 may be provided so as to be positioned between the key edge 19 and the wider wall 41 of the casing opening. If desired, each of the recesses 35 and 37 can be enlarged somewhat in the vicinity of the wall 41 so as to positively hold the spring 63 in place in the casing. Thus, if a force is exerted on the casing and a reaction force is applied to the shank 15 of the key, the key will pivot about an axis extending along key edge 17 so that one face or the other, i.e., 21 or 23, will be positioned against a wall 35 or 37 of the opening.

Those skilled in the art will realize that the key 11 will pivot to a position away from the direction in which the casing is rotated. Thus, for example, considering the structure shown in FIGS. 1-5, if the key is inserted into a lock with the key oriented as shown, i.e., the teeth on the bit down, when the lock is turned in a clockwise direction, the key will pivot to the position shown in FIG. 3. If the lock is turned in the counterclockwise direction, the key will pivot into the position shown in FIG. 4.

Those skilled in the art will also realize that it is only necessary to look at the relative position of the key and the housing in order to determine which way the lock was last turned. However, if desired, one half of the casing may be provided with an opening or aperture 67. Similarly, an edge of the key which is to be located adjacent the wall 41 may be provided with a slot or piercing 69 and an indicator element, such as that depicted at 71, may be installed in the slot 69. Thus, when the key is pivoted to the position shown in FIG. 3, the indicator 71 will extend through the opening 71 and beyond the periphery of the casing, as illustrated. On the other hand, when the key is pivoted to the opposite position, the indicator 71 will be withdrawn to a position within the outer periphery of the housing and fingers of the user will not be able to feel it. Thus, the user could merely reach into a pocket or purse, feel the edge of the casing, and determine whether or not the key was last actuated so that the lock was positioned in the desired mode.

Figure 6:
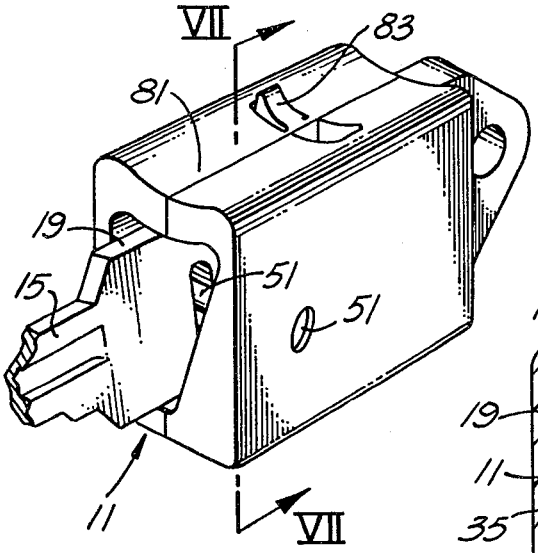
FIG. 6 comprises a perspective view of a second embodiment of a device formed in accordance with the present invention.
Figure 7:
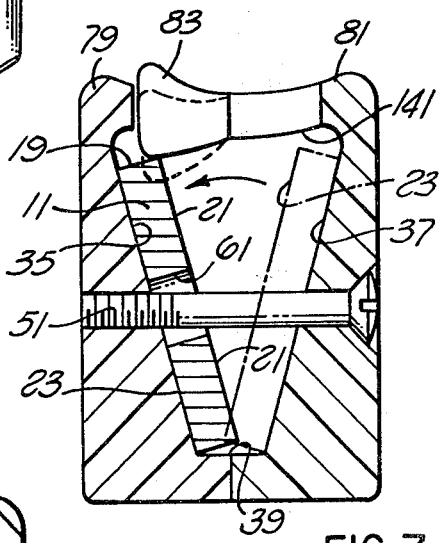
FIG. 7 comprises a sectional view of the device shown in FIG. 6, as seen along a line VII—VII.

Referring now to FIGS. 6 and 7, a similar device has been depicted and only those elements which differ from those described in the first embodiment will be discussed here. In this embodiment, the housing may be provided either as a pair of sections, as previously depicted, or as a single casing 79. If desired, the single casing may be provided with a depressed portion 81 in the relatively wider wall 141. In other words, the relatively wider wall need not be parallel to the narrower wall 39 but can extend somewhat into the opening containing the key 11. Thus, the relatively wider wall 141 may provide the reaction force to inhibit movement of the key between the pivotal extremities depicted in FIG. 7.

In this embodiment, a partial piercing 83 may be formed in the upper wall 141. The portion 83 may be severed from the upper wall along three sides, but remain attached thereto near the center line of the housing.

Referring to FIG. 7, it can be seen that when face 23 of the key 11 is in planer abutment with wall 35 of the housing, edge 19 of the key will bear against the piercing 83 and force it slightly above the outer periphery of the wall 141. On the other hand, when the face 21 is in planer abutment with its adjacent side wall 37 of the housing, the pierced portion 83 will recede to a position at least even with the outer periphery of wall 141, or below.

Those skilled in the art will realize, of course, that two such piercings, on opposite sides of the housing center line, may be provided, if desired. In such a case, each piercing will be activated when the key is pivoted to its respective side of the housing center line. Alternatively, one of the piercings may be broken away so that a pierced portion, such as 83, will serve as an indicator only when the key is in the selected position.

Figure 8:
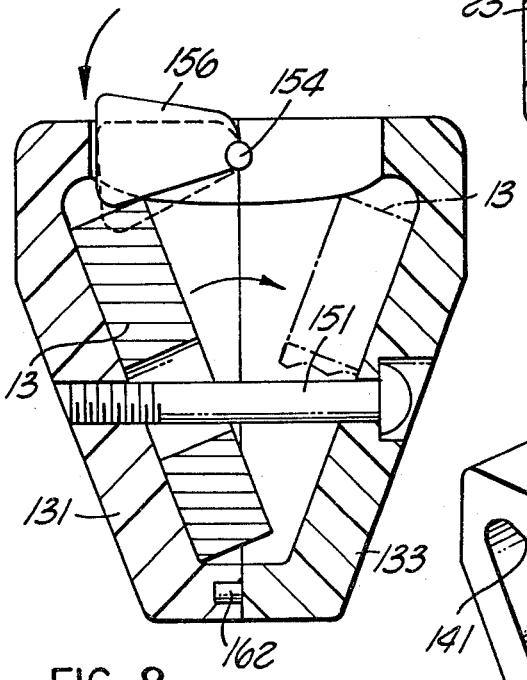
FIG. 8 comprises a view, similar to FIG. 7 of a third embodiment of the present invention.
Figure 9:
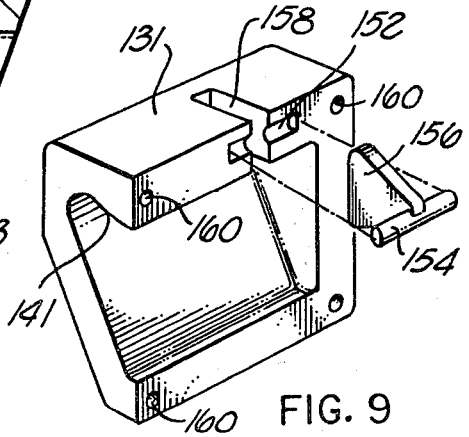
FIG. 9 comprises a perspective view of two elements employed in the form of the invention depicted in FIG. 8.

As shown in FIGS. 8 and 9, if desired a housing formed in accordance with the present invention may again be formed in two distinct halves 131 and 133. In this embodiment, as shown in FIG. 9, the body of the casing half 131 adjacent the relatively wider wall 141, may be provided with a shaft-receiving recess 152 for receipt of a pivot shaft 154. The pivot shaft may be formed integral with or attached to a paddle-like indicator 156 as illustrated. The paddle-like member may be provided with any suitable configuration, although it is presently preferred that when the shaft 154 is installed in the receiver 152, the upper and lower corners of the paddle are so sized and shaped that they cannot pass the distal edges of an opening 158 through which the paddle may move. Thus, with the key in the position depicted in FIG. 8, the paddle will be pushed upwardly slightly out of the opening 158 to provide the desired indication. Similarly, when the key is pivoted to the position illustrated in phantom, the paddle will fall to a position below the periphery of the casing, or at least in alignment therewith, and provide a clear indication to the user that the key has been pivoted to the other position. Again, if desired, an opening 158 may be provided in each half of the casing so that the paddle 156 can be used to serve as a positive indicator for either of the positions of the key. Also, one half 131 of the casing may be provided with blind bores 160 and the other half 133 may be provided with alignment pins 162. Thus, when joining the two halves of the casing, the pins 162 may be inserted into the bores 160 and a single screw 151 may be used to join the halves of the casing to one another, as well as to hold the key within the casing.

It will now be clear to those skilled in the art that the present invention provides a device which overcomes all of the deficiencies of the related devices of the prior art. The device is very simple and inexpensive and it can be positioned on substantially any key, without requiring any specific relationship between the position of the casing and the shank of the key along the length of the shank. Any key can be positioned, with the teeth up or down, in the casing and an average homemaker or inexperienced locksmith can reform the head of any key so as to fit into such a casing and allow use of an indicator.

Having perused this detailed description and the accompanying drawings, those skilled in the art will realize that the present invention may be employed in a wide variety of structures, many of which are simple and do not require any particular key, lock, or relationship between the key and the structure. Many devices which will now be apparent to those skilled in the art may not even resemble those depicted here; nevertheless, they will employ the teaching and spirit of the present invention as defined in the following claims.

I claim:

1. A device for indicating whether the user of a key left a lock in its locked or unlocked condition comprising:

a key having
- a shank and
- a handle, the handle having
  - a first edge;
  - a second edge; and
  - a pair of faces between the first and second edges;

a key-holding compartment extending inwardly from one edge of a housing and having
- a first wall which is relatively narrow for pivotably seating the first edge of the key handle, a second wall which is relatively wide and distal from the first edge within the housing, a pair of side walls interconnecting the first and second walls, the faces of the key handle being selectively locatable adjacent the side walls;

means for positioning the key in the compartment such that the shank extends out of the housing and the key may be pivoted about an axis extending parallel to and along its first edge; and means for releasably holding the key in the pivoted position extremities thereof such that one of the faces of the key handle is in facial abutment with a side wall at times when a lock is not being actuated by the key.

2. The device of claim 1 wherein the holding means comprises flat spring means positioned between one of the first and second walls and the corresponding handle edge.

3. The device of claim 1 including means for providing a signal external of the housing to positively indicate the pivotal position of the key relative to the housing.

4. The device of claim 3 wherein the signal providing means comprises means attached to the key and extensible out of the housing when the key is pivoted to one pivotal extremity and retractible into the housing when the key is pivoted to the other pivotal extremity.

5. The device of claim 3 wherein the signal providing means comprises means forming a partially pierced portion of the housing located in a wall of the housing in close proximity to one edge of the key so that the partially pierced portion is elevated out of the plan of the housing exterior when the key is in a first pivotal extremity and at least in the plane of the housing exterior when the key is in the second pivotal extremity.

6. The device of claim 3 wherein the signal providing means comprises means pivotally mounted in the housing so as to extend outwardly therefrom when the key is at one pivotal extremity within the housing and to be at least partially retracted into the housing when the key is in the other pivotal extremity.

7. The device of claim 6 wherein the housing includes means for supporting the signal providing means for pivotal movement relative to the housing comprising shaft-receiving means; and the pivotally mounted means comprises indicator means and shaft means extending substantially perpendicular to the indicator means and seated in the shaft-receiving means.

8. A device for indicating the position into which a lock was last actuated by the user of a key comprising:

a housing including a first half and a second half, each half including a surface recess so located as to cooperate with the other recess when the halves are in operative abutment, each recess being relatively shallow adjacent one edge of its respective half, extending substantially uniformly to be relatively deep adjacent an opposite edge of its respective half, and extending to an intermediate edge of its respective half means for joining the housing halves so that the relatively shallow portions of the recesses are opposed to one another and the relatively deep portions of the recesses are also opposed to one another, thus forming an opening within the housing;

a key having a shank and a handle including a first edge and a second edge;

means for holding the key within the opening such that the key shank extends out of the housing with the first edge thereof positioned adjacent the shallow portions of the recesses and the second edge movable between the relatively deep portions thereof;

means for inhibiting but not prohibiting movement of the second edge of the key between opposite sides of the opening formed by the recesses adjacent the relatively deep portions thereof; and means for providing an indication, on the exterior of the housing, of the position of the second key edge relative to the relatively deep portions of the recesses.

9. The device of claim 8 wherein the housing further includes an opening therein through which the indication providing means is extensible.

10. The device of claim 8 or 9 wherein the indication providing means comprises a portion of the housing wall which is partially pierced, thus forming the opening partially thereabout.

11. The device of claim 10 wherein the partially pierced portion of the housing wall is located therein for cooperation with the second edge of the key when the latter is adjacent one side of the opening in the housing.

12. The device of claim 8 or 9 wherein the indication providing means comprises means fixed to the key for movement to a position exterior of the housing when the key is in a first position within the housing and for movement to a position substantially wholly within the housing when the key is in a second position within the housing.

13. The device of claim 8 or 9 wherein the indication providing means comprises means releasably held between the first and second halves of the housing so as to be selectively positionable in accordance with the needs of the user to allow the indication means to be selectively provided in either of the terminal movement positions of the second key edge.

14. A device for indicating to the user of a key whether the lock last actuated by the key was left in the locked or unlocked condition comprising:

a casing having an opening therein of approximately triangular cross-sectional configuration including a first, relatively narrow wall of slightly greater width than the key and a second, relatively wide wall, the opening extending to one edge of the casing;

a key within the casing and having a shank extending outwardly from the opening and a handle having a first edge extending along the first wall of the opening and a second edge extending generally along the second wall of the opening;

means for limiting movement of the key to pivotal movement within the opening about an axis extending along the first edge between a first position in which the second edge is adjacent one side of the second wall and a second position in which the second edge is adjacent the other side of the second wall; and means, actuated by the key upon pivotal movement thereof within the casing in a first direction, for locating an indicator exteriorly of the casing periphery and, upon pivotal movement of the key in the second direction, for withdrawing the indicator to a position which is at least coextensive with the periphery of the casing.

15. The device of claim 14 including means extending into the opening for cooperation with the second key edge to inhibit movement of the second edge within the casing.

* * * * *